United States Patent [19]

Tokumitsu

[11] Patent Number: 4,727,361

[45] Date of Patent: Feb. 23, 1988

[54] DIGITAL VIDEO ENCODER CIRCUIT

[75] Inventor: Shigenori Tokumitsu, Fukaya, Japan

[73] Assignee: Kabushiki Kaisha Toshiba, Kawasaki, Japan

[21] Appl. No.: 10,144

[22] Filed: Feb. 2, 1987

[30] Foreign Application Priority Data

Jan. 31, 1986 [JP] Japan ..... 61-18144
Mar. 24, 1986 [JP] Japan ..... 61-64152

[51] Int. Cl.[4] ..... G09G 1/28
[52] U.S. Cl. ..... 340/703; 358/23
[58] Field of Search ..... 340/703; 358/13, 23

[56] References Cited

U.S. PATENT DOCUMENTS 4,271,409 6/1981 Filliman ..... 340/703
4,303,912 12/1981 Stafford ..... 340/703

FOREIGN PATENT DOCUMENTS 0030115 3/1977 Japan ..... 358/13
0018182 1/1982 Japan ..... 358/23
0137382 8/1983 Japan ..... 358/13
0175392 10/1983 Japan ..... 358/23
0028788 2/1984 Japan ..... 358/23
0211394 11/1984 Japan ..... 358/23

*Primary Examiner*—John W. Shepperd

*Attorney, Agent, or Firm*—Cushman, Darby & Cushman

[57] ABSTRACT

A decoder decodes digital color information data from an input section into a predetermined number of pieces of color information consisting of specific color information and specific luminance information. A first converter converts the specific luminance information of each of the predetermined number of pieces of color information into a digital luminance signal component. A second converter converts the two color difference signals uniquely defined by the relationship between the specific color information and the specific luminance information of each of the predetermined number of pieces of information into a digital color difference signal component. A modulator digitally performs balanced modulation for the two color subcarrier components having phases shifted by 90 degrees from a color subcarrier component generator by using the digital color difference signal components, and outputs digital carrier chrominance signal components. An adder adds the digital carrier chrominance signal components from the modulator and the digital luminance signal component, and outputs digital video signal components. A third converter converts the digital video signal components into an analog waveform and outputs an analog video signal.

9 Claims, 28 Drawing Figures

FIG. 3

| COLOR | SY | R | G | B | Y | S14 | S13 | S12 | S11 | S10 | S9 | S8 | S7 | S6 | S5 | S4 | S3 | S2 | S1 | S0 |
|---|---|---|---|---|---|---|---|---|---|---|---|---|---|---|---|---|---|---|---|---|
| (SYNC SIGNAL) | L | * | * | * | * | H | H | H | H | H | H | H | H | H | H | H | H | H | H | H |
| FULL LUMINANCE WHITE | H | H | H | H | H | L | H | H | H | H | H | H | H | H | H | H | H | H | H | H |
| HALF LUMINANCE WHITE | H | H | H | H | L | H | L | H | H | H | H | H | H | H | H | H | H | H | H | H |
| FULL LUMINANCE YELLOW | H | H | H | L | H | H | H | L | H | H | H | H | H | H | H | H | H | H | H | H |
| HALF LUMINANCE YELLOW | H | H | H | L | L | H | H | H | L | H | H | H | H | H | H | H | H | H | H | H |
| FULL LUMINANCE MAGENTA | H | H | L | H | H | H | H | H | H | L | H | H | H | H | H | H | H | H | H | H |
| HALF LUMINANCE MAGENTA | H | H | L | H | L | H | H | H | H | H | L | H | H | H | H | H | H | H | H | H |
| FULL LUMINANCE RED | H | H | L | L | H | H | H | H | H | H | H | L | H | H | H | H | H | H | H | H |
| HALF LUMINANCE RED | H | H | L | L | L | H | H | H | H | H | H | H | L | H | H | H | H | H | H | H |
| FULL LUMINANCE CYAN | H | L | H | H | H | H | H | H | H | H | H | H | H | L | H | H | H | H | H | H |
| HALF LUMINANCE CYAN | H | L | H | H | L | H | H | H | H | H | H | H | H | H | L | H | H | H | H | H |
| FULL LUMINANCE GREEN | H | L | H | L | H | H | H | H | H | H | H | H | H | H | H | L | H | H | H | H |
| HALF LUMINANCE GREEN | H | L | H | L | L | H | H | H | H | H | H | H | H | H | H | H | L | H | H | H |
| FULL LUMINANCE BLUE | H | L | H | L | L | H | H | H | H | H | H | H | H | H | H | H | H | L | H | H |
| HALF LUMINANCE BLUE | H | L | L | H | L | H | H | H | H | H | H | H | H | H | H | H | H | H | L | H |
| BLACK | H | L | L | L | * | H | H | H | H | H | H | H | H | H | H | H | H | H | H | L |

*: DON'T CARE

FIG. 4

| COLOR | $E_R$ | $E_G$ | $E_B$ | $E_Y$ | $\frac{E_R-E_Y}{1.14}$ | $\frac{E_B-E_Y}{2.03}$ |
|---|---|---|---|---|---|---|
| FULL LUMINANCE WHITE | 1 | 1 | 1 | 1.0 | 0 | 0 |
| HALF LUMINANCE WHITE | 0.5 | 0.5 | 0.5 | 0.5 | 0 | 0 |
| FULL LUMINANCE YELLOW | 1 | 1 | 0 | 0.89 | 0.096 | −0.438 |
| HALF LUMINANCE YELLOW | 0.5 | 0.5 | 0 | 0.445 | 0.048 | −0.219 |
| FULL LUMINANCE MAGENTA | 1 | 0 | 1 | 0.41 | 0.517 | 0.290 |
| HALF LUMINANCE MAGENTA | 0.5 | 0 | 0.5 | 0.205 | 0.258 | 0.145 |
| FULL LUMINANCE RED | 1 | 0 | 0 | 0.3 | 0.614 | −0.147 |
| HALF LUMINANCE RED | 0.5 | 0 | 0 | 0.15 | 0.307 | −0.073 |
| FULL LUMINANCE CYAN | 0 | 1 | 1 | 0.7 | −0.614 | 0.147 |
| HALF LUMINANCE CYAN | 0 | 0.5 | 0.5 | 0.35 | −0.307 | 0.073 |
| FULL LUMINANCE GREEN | 0 | 1 | 0 | 0.59 | −0.517 | −0.290 |
| HALF LUMINANCE GREEN | 0 | 0.5 | 0 | 0.295 | −0.258 | −0.145 |
| FULL LUMINANCE BLUE | 0 | 0 | 1 | 0.11 | −0.096 | 0.438 |
| HALF LUMINANCE BLUE | 0 | 0 | 0.5 | 0.055 | −0.048 | 0.219 |
| BLACK | 0 | 0 | 0 | 0 | 0 | 0 |

FIG. 6

| COLOR | $E_Y$ | | | | | | | | | $(E_R-E_Y)/1.14$ | | | | | | | | $(E_B-E_Y)/2.03$ | | | | | | | |
|---|---|---|---|---|---|---|---|---|---|---|---|---|---|---|---|---|---|---|---|---|---|---|---|---|---|
| | DECIMAL VALUE | (BINARY VALUE) MSB | | | | | | | LSB | DECIMAL VALUE | (BINARY VALUE) MSB | | | | | | LSB | DECIMAL VALUE | (BINARY VALUE) MSB | | | | | | LSB |
| FULL LUMINANCE WHITE | 140 | 1 | 0 | 0 | 0 | 1 | 1 | 0 | 0 | 0 | 0 | 0 | 0 | 0 | 0 | 0 | 0 | 0 | 0 | 0 | 0 | 0 | 0 | 0 | 0 |
| HALF LUMINANCE WHITE | 90 | 0 | 1 | 0 | 1 | 1 | 0 | 1 | 0 | 0 | 0 | 0 | 0 | 0 | 0 | 0 | 0 | 0 | 0 | 0 | 0 | 0 | 0 | 0 | 0 |
| FULL LUMINANCE YELLOW | 129 | 1 | 0 | 0 | 0 | 0 | 0 | 0 | 1 | 10 | 0 | 0 | 0 | 1 | 0 | 1 | 0 | -44 | 1 | 0 | 1 | 0 | 1 | 0 | 0 |
| HALF LUMINANCE YELLOW | 85 | 0 | 1 | 0 | 1 | 0 | 1 | 0 | 1 | 5 | 0 | 0 | 0 | 0 | 1 | 0 | 1 | -22 | 1 | 1 | 0 | 1 | 0 | 1 | 0 |
| FULL LUMINANCE MAGENTA | 81 | 0 | 1 | 0 | 1 | 0 | 0 | 0 | 1 | 52 | 0 | 1 | 1 | 0 | 1 | 0 | 0 | 29 | 0 | 0 | 1 | 1 | 1 | 0 | 1 |
| HALF LUMINANCE MAGENTA | 61 | 0 | 0 | 1 | 1 | 1 | 1 | 0 | 1 | 26 | 0 | 0 | 1 | 1 | 0 | 1 | 0 | 15 | 0 | 0 | 0 | 1 | 1 | 1 | 1 |
| FULL LUMINANCE RED | 70 | 0 | 1 | 0 | 0 | 0 | 1 | 1 | 0 | 61 | 0 | 1 | 1 | 1 | 1 | 0 | 1 | -15 | 1 | 1 | 1 | 0 | 0 | 0 | 1 |
| HALF LUMINANCE RED | 55 | 0 | 0 | 1 | 1 | 0 | 1 | 1 | 1 | 31 | 0 | 0 | 1 | 1 | 1 | 1 | 1 | -7 | 1 | 1 | 1 | 1 | 0 | 0 | 1 |
| FULL LUMINANCE CYAN | 110 | 0 | 1 | 1 | 0 | 1 | 1 | 1 | 0 | -61 | 1 | 0 | 0 | 0 | 0 | 1 | 1 | 15 | 0 | 0 | 0 | 1 | 1 | 1 | 1 |
| HALF LUMINANCE CYAN | 75 | 0 | 1 | 0 | 0 | 1 | 0 | 1 | 1 | -31 | 1 | 1 | 0 | 0 | 0 | 0 | 1 | 7 | 0 | 0 | 0 | 0 | 1 | 1 | 1 |
| FULL LUMINANCE GREEN | 99 | 0 | 1 | 1 | 0 | 0 | 0 | 1 | 1 | -52 | 1 | 0 | 0 | 1 | 1 | 0 | 0 | -29 | 1 | 1 | 0 | 0 | 0 | 1 | 1 |
| HALF LUMINANCE GREEN | 70 | 0 | 1 | 0 | 0 | 0 | 1 | 1 | 0 | -26 | 1 | 1 | 0 | 0 | 1 | 1 | 0 | -15 | 1 | 1 | 1 | 0 | 0 | 0 | 1 |
| FULL LUMINANCE BLUE | 51 | 0 | 0 | 1 | 1 | 0 | 0 | 1 | 1 | -10 | 1 | 1 | 1 | 0 | 1 | 1 | 0 | 44 | 0 | 1 | 0 | 1 | 1 | 0 | 0 |
| HALF LUMINANCE BLUE | 46 | 0 | 0 | 1 | 0 | 1 | 1 | 1 | 0 | -5 | 1 | 1 | 1 | 1 | 0 | 1 | 1 | 22 | 0 | 0 | 1 | 0 | 1 | 1 | 0 |
| BLACK | 40 | 0 | 0 | 1 | 0 | 1 | 0 | 0 | 0 | 0 | 0 | 0 | 0 | 0 | 0 | 0 | 0 | 0 | 0 | 0 | 0 | 0 | 0 | 0 | 0 |
| (SYNC SIGNAL) | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

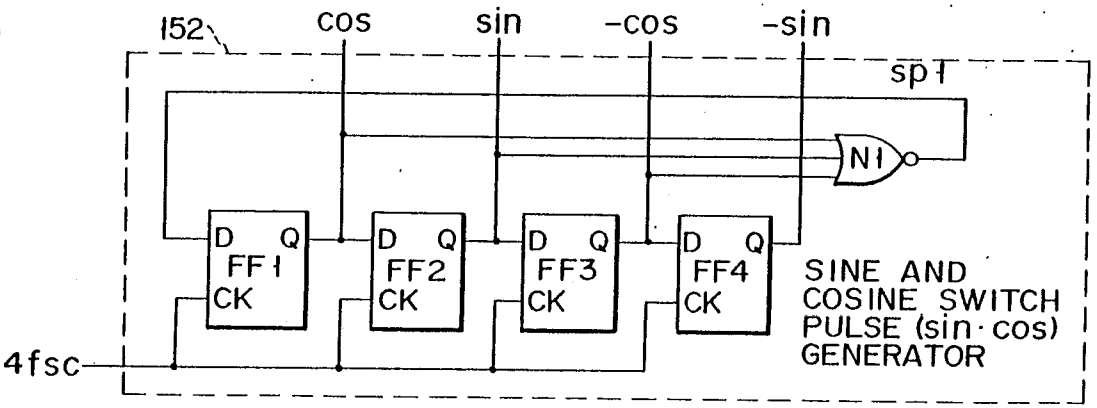
FIG. 13
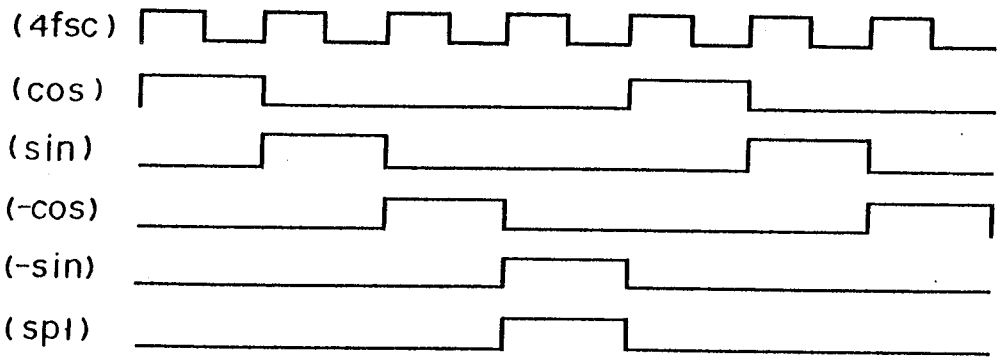
FIG. 14A
FIG. 14B
FIG. 14C
FIG. 14D
FIG. 14E
FIG. 14F

DIGITAL VIDEO ENCODER CIRCUIT

BACKGROUND OF THE INVENTION

This invention relates to a digital video encoder circuit and, more particularly, to a circuit for converting a digital chrominance signal from a display controller to an analog video signal according to a digital scheme.

In conventional systems such as a videotex system and a teletext system, character and graphic images are stored as digital data in an image memory, read out at a timing synchronized with raster scanning on a monitor CRT by a CRT (display) controller, and displayed on the CRT. Since color information data is normally read out as a digital waveform from these conventional systems, a special monitor for receiving a digital RGB signal is required. For this reason, when a standard television receiver capable of receiving only normal analog video signal serves as a monitor, a video encoder circuit is required to convert a digital chrominance signal into an analog video signal.

A conventional video encoder circuit is constituted by an analog circuit such as an analog IC.

When an analog video encoder IC is used, a large number of discrete peripheral components such as resistors, capacitors, inductors and delay lines are required, thus resulting in complicated assembly and adjustment and degrading reliability of the circuit itself. Electrical values of these components vary according to changes and deterioration over time. As a result, the electrical characteristics are undesirably degraded.

SUMMARY OF THE INVENTION

It is, therefore, an object of the present invention to provide a new and improved digital video encoder circuit which requires only a small number of peripheral circuit elements for converting a digital chrominance signal into an analog signal, thereby simplifying the assembly and adjustment processes, eliminating degradation of the electrical characteristics, and hence improviding circuit reliability.

According to the present invention, there is provided a digital video encoder circuit comprising:

input means for receiving digital color information data to be encoded, the digital color information data including a plurality of color components and a luminance component having a predetermined relationship therewith;

decoding means for receiving the digital color information data from the input means and decoding the digital color information data into a predetermined number of pieces of color information consisting of specific color information and specific luminance information, the specific color information being uniquely defined by the relationship between the plurality of color components and the luminance component, and the specific luminance information being adapted to have a predetermined relationship with the specific color information;

first converting means for receiving the predetermined number of pieces of color information, converting the specific luminance information of each of the predetermined number of pieces of color information into a digital luminance signal component uniquely defined by the relationship between the specific color information and the specific luminance information, and outputting the digital luminance signal component;

second converting means for receiving the predetermined number of pieces of color information from the decoding means, converting two color difference signals uniquely defined by the relationship between the specific color information and the specific luminance information of each of the predetermined number of pieces of information into a digital color difference signal component, and outputting the digital color difference signal component;

color subcarrier component generating means for generating two color subcarrier components, the phases of which are shifted by 90 degrees;

modulating means for digitally performing balanced modulation for the two color subcarrier components having phases shifted by 90 degrees from the color subcarrier component generating means by using the digital color difference signal components from the second converting means, and for outputting digital carrier chrominance signal components;

adding means for adding the digital carrier chrominance signal components from the modulating means and the digital luminance signal component from the first converting means, and for outputting digital video signal components; and third converting means for converting the digital video signal components from the adding means into an analog waveform and for outputting an analog video signal.

BRIEF DESCRIPTION OF THE DRAWINGS

These and other objects and features of the present invention can be understood through the following embodiments by reference to the accompanying drawings, in which:

FIG. 3 is a table for explaining the operation of the color decoder in FIG. 2;

FIGS. 4 to 6 are charts respectively showing relative values between luminance signals and color difference signals, the relative amplitude values of color bar signals, and the binary data of the respective decoded color components;

FIG. 13 is a circuit diagram showing a detailed arrangement of a sine and cosine switching pulse (Sin-Cos) generator in FIG. 1;

FIGS. 14A to 14F are timing charts for explaining the operation of FIG. 13;

DETAILED DESCRIPTION OF THE PREFERRED EMBODIMENTS

The principle of the present invention will be described hereinafter. According to the present invention, a digital chrominance signal is sampled at a predetermined frequency. A luminance signal component and two color difference signal components of the chrominance signal are converted into digital values. The converted color difference signal components are digitally subjected to balanced modulation to obtain carrier chrominance signal components. These components together with the luminance signal component constitute a digital video signal. In this manner, digital arithmetic operations are performed to prepare the video signal, thereby achieving the above object.

Video encoder circuits according to preferred embodiments of the present invention will be described with reference to the accompanying drawings.

Figure 1:
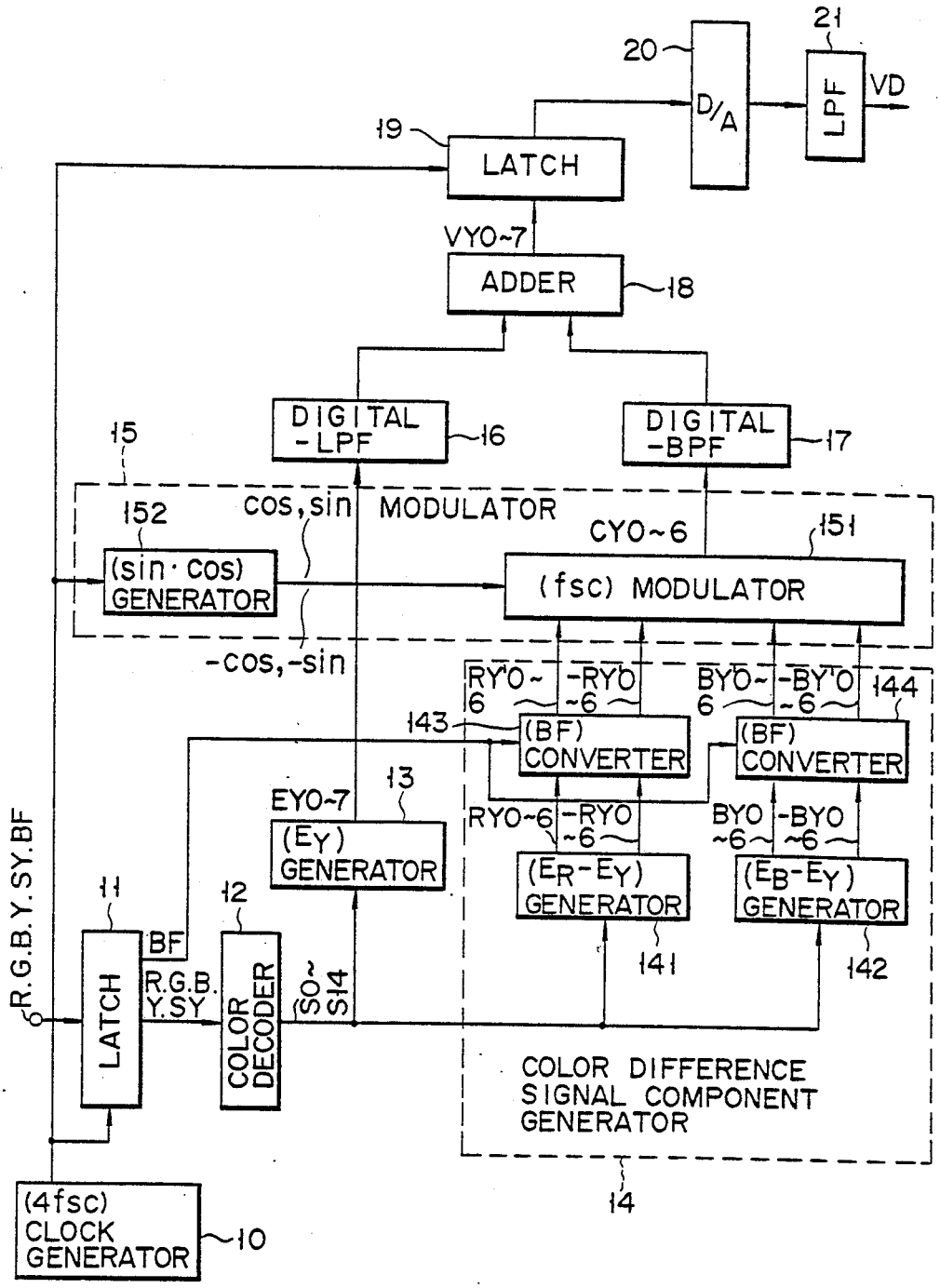
FIG. 1 is a block diagram showing a digital video encoder circuit according to a first embodiment of the present invention.

Referring to FIG. 1 illustrating a video encoder circuit according to a first embodiment of the present invention, latch 11 samples a digital signal including red, green, blue, luminance and composite sync signals R, G, B, Y and SY output in synchronism with raster scanning under the control of a display controller in a digital signal source (not shown) such as a videotex or teletext system. This digital signal also includes burst flag signal BF representing a color burst superposing position. Among the signals sampled by latch 11, signals R, G, B, Y and SY are converted into corresponding color information signals S0 to S14 by color decoder 12.

Luminance signal component generator 13 converts luminance signals EY of colors represented by color information signals S0 to S14 into binary data bits EY0 to EY7. Color difference signal generator 14 converts color difference signals (ER−EY and EB−EY) of red and green into binary value data signals $RY_{0-6}$, $-RY_{0-6}$, $BY_{0-6}$ and $-BY_{0-6}$. Generator 14 generates binary value data signals $RY'_{0-6}$, $-RY'_{0-6}$, $BY'_{0-6}$ and $-BY'_{0-6}$ corresponding to the amplitudes of color burst signals during generation of burst flag signals BF. Modulator 15 performs balanced modulation of color subcarriers having phases shifted by 90 degrees, by using the two color difference signals output from generator 14. Modulator 15 then outputs carrier chrominance signal component $CY_{0-6}$.

Digital low-pass filter 16 performs an arithmetic operation having the same characteristics as a normal analog low-pass filter. This arithmetic operation is performed for luminance signal component $EY_{0-7}$ generated by generator 13, thereby limiting interference to the carrier chrominance signal component. Digital band-pass filter 17 performs the same operation as described above. This operation is performed for component $CY_{0-6}$, thereby preventing interference to the luminance signal component. The luminance signal component from the low-pass filter and the carrier chrominance signal from the band-pass filter are added by adder 18 to produce digital video signal component $VY_{0-7}$. This video signal component is latched by latch 19 and converted into an analog video signal by D/A converter 20 at a proper timing. The high-frequency component of the analog video signal is cut off by normal analog low-pass filter 21, thereby outputting (analog) video signal VD.

The operation of the circuit having the above arrangement will be described below.

Figure 2:
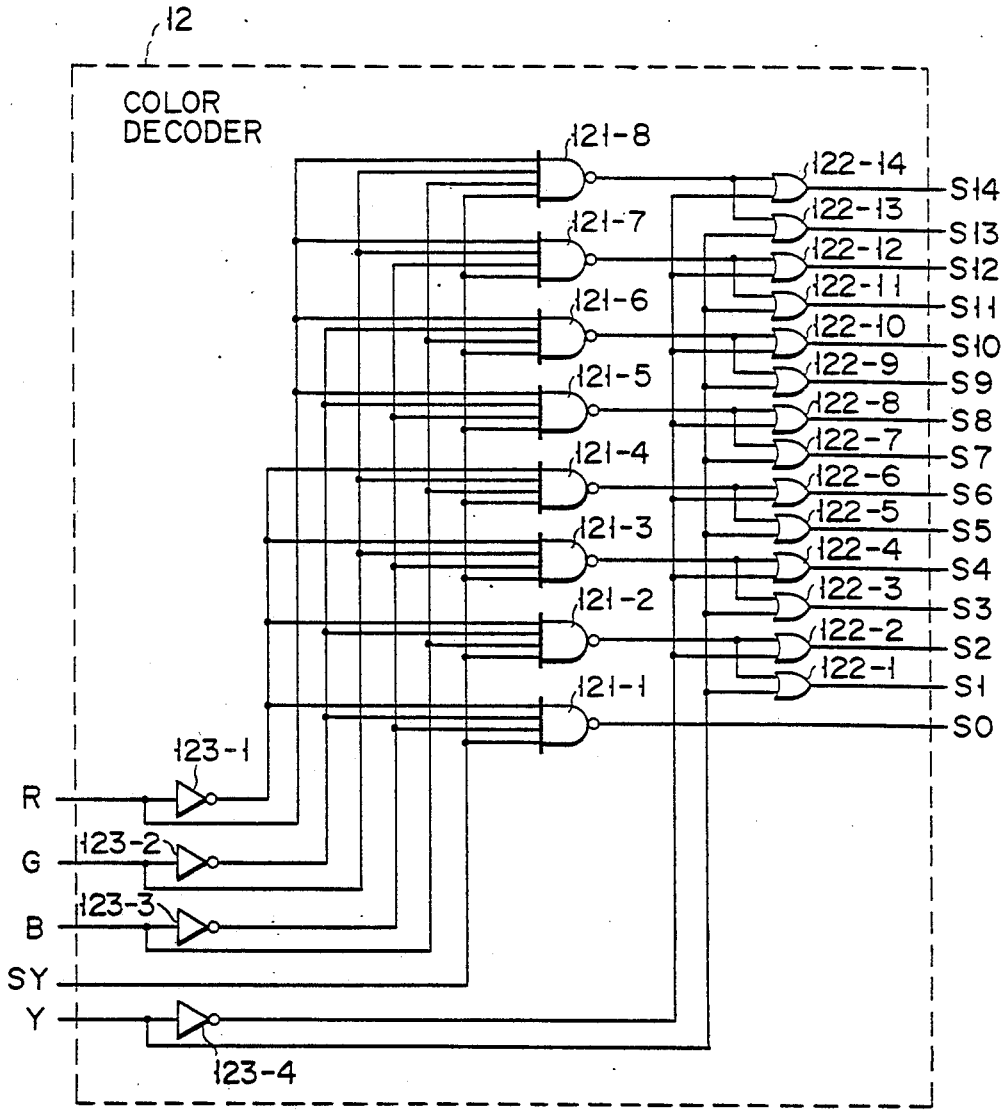
FIG. 2 is a circuit diagram showing a detailed arrangement of a color decoder in FIG. 1.

Digital signals R, G, B, Y, SY and BF, output from a display controller (not shown), are latched and sampled by latch 11 in response to clocks having a frequency 4fsc (fsc is the color subcarrier frequency). Signals R, G and B are color information signals representing 8 different colors, and signal Y is color information signal representing two luminance levels. Color decoder 12 converts each color information into one of color information signals S0 to S14. The circuit arrangement and operation state of color decoder 12 are respectively shown in FIGS. 2 and 3. Referring to FIG. 2, signals R, G and B are selectively supplied to NAND gates 121-1 to 121-8 directly and through inverters 123-1 to 123-3 to determine which one of colors (white, yellow, magenta, red, cyan, green, blue and black) is represented by the input signals. The decoded results are selectively input to OR gates 122-1 to 122-14 directly and signal Y is supplied thereto directly and through inverter 123-4 to determine whether each decoded result represents one of the luminance levels (i.e., full luminance and half luminance). The input signals are decoded such that one of signals S0 to S14 is set at level "L" for 15 colors, i.e., 8 (colors)×2 (luminance levels) ("black" has only one luminance level), as shown in FIG. 3. If signal SY is set at level "L" during the period of composite sync signal, the NAND and OR gates convert all signals S0 to S14 into "H" level signals, thereby simplifying subsequent signal processing.

In the normal NTSC scheme, luminance signal EY and two color difference signals ER−EY and EB−EY of each of three primary color signals ER, EG and EB are represented by the following equations:

$$EY=0.30ER+0.59EG+0.11EB \quad (1)$$

$$ER-EY=0.70ER-0.59EG-0.11EB \quad (2)$$

$$EB-EY=-0.3ER-0.59EG+0.89EB \quad (3)$$

Figure 5:
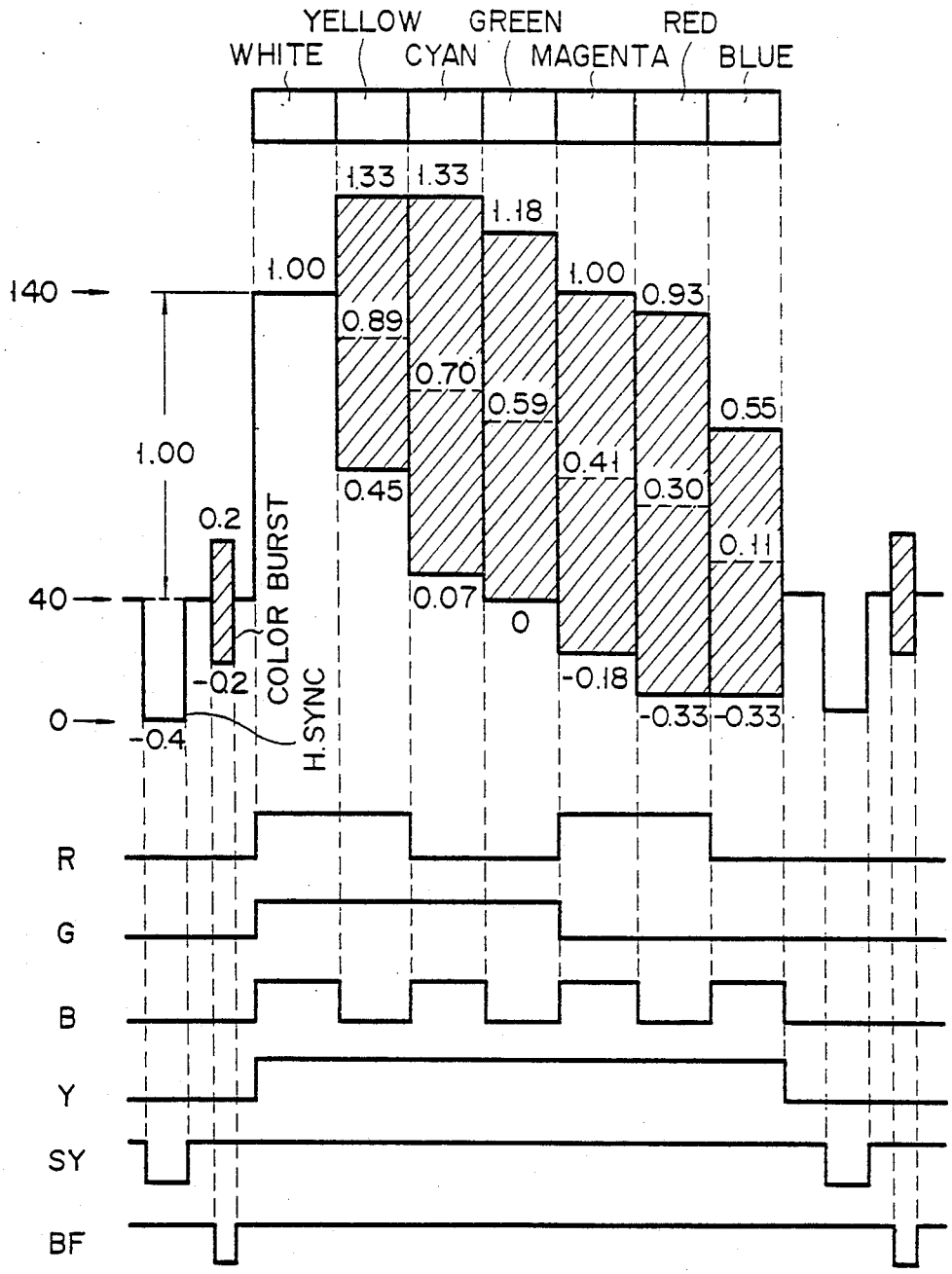

In order to prevent overmodulation, the amplitudes of signals ER−EY and EB−EY are limited to 1/1.14 and 1/2.03, respectively. Therefore, the relative values of luminance signal EY and color difference signals (ER−EY)/1.14 and (EB−EY)/2.03 are given as values in FIG. 4. When the relative amplitude values of the color bar signals for a monitor test-pattern are represented by using the above values in association with the timings of signals R, G, B, Y, SY and BY, they are as shown in FIG. 5. In this embodiment, the ratio of full luminance to half luminance is set to be 2:1. However, the ratio may be obtained by using $\gamma$-corrected values.

Figure 7:
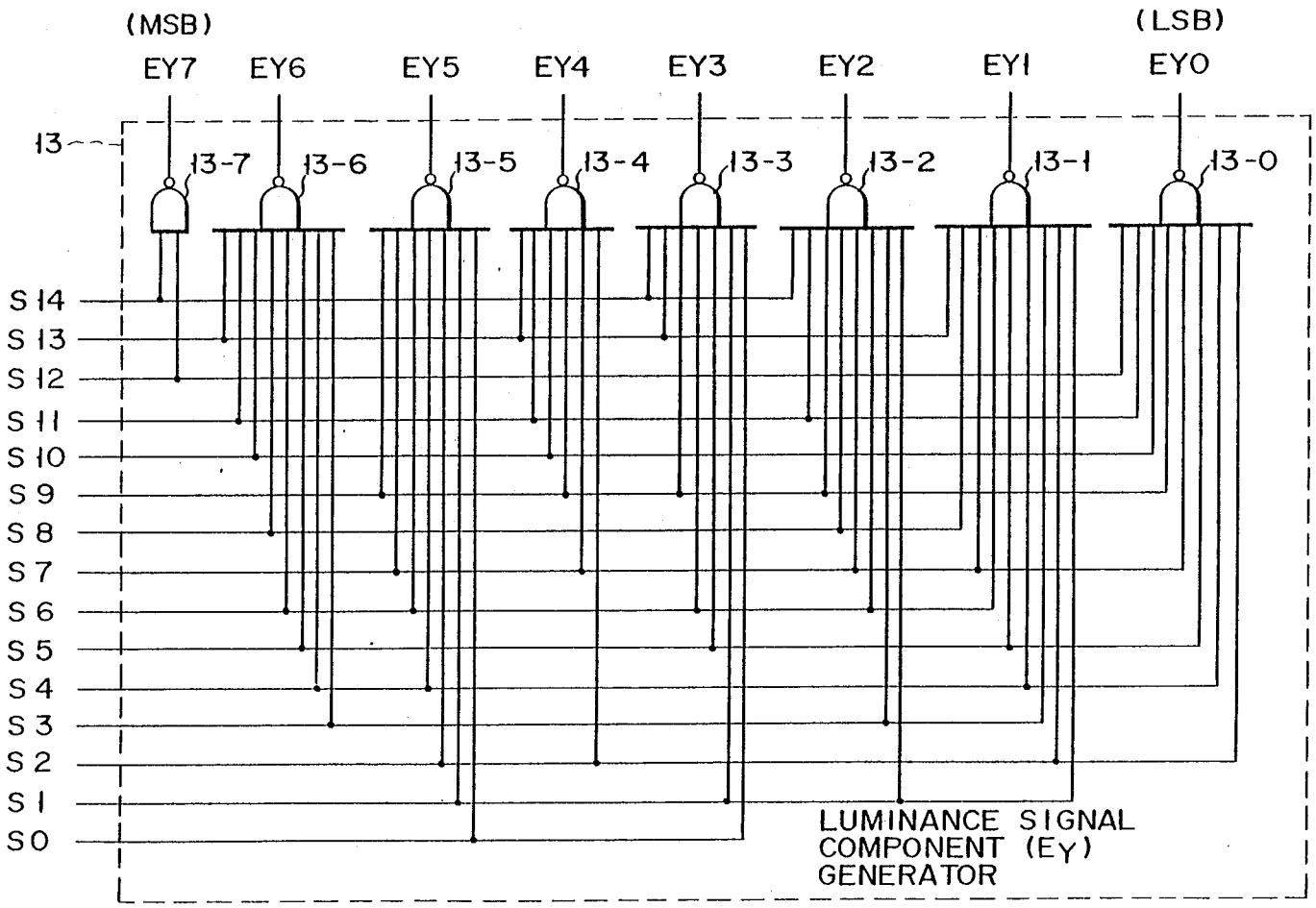
FIG. 7 is a circuit diagram showing a detailed arrangement of a luminance signal component (EY) generator in FIG. 1.
Figure 8:
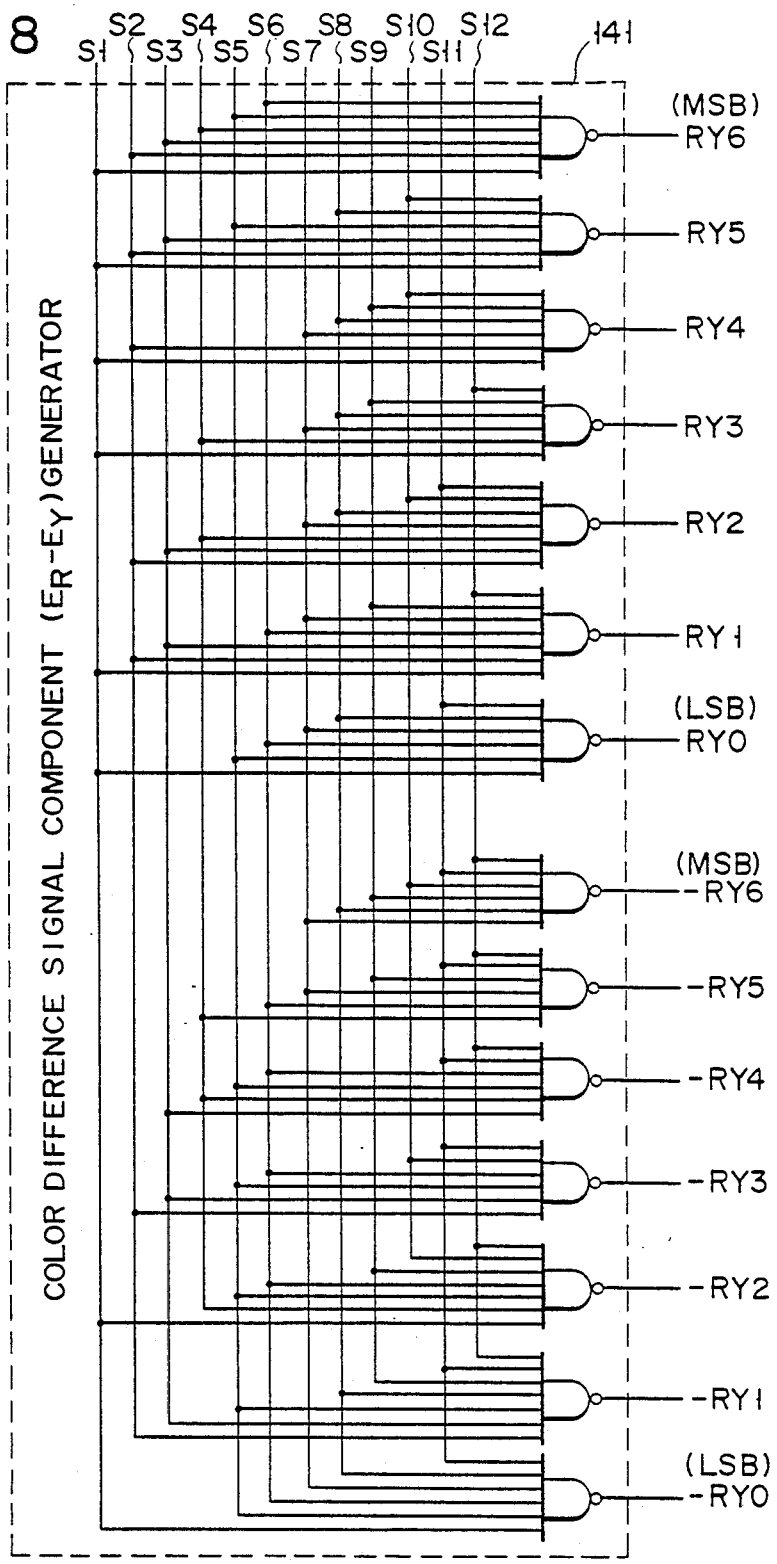
FIG. 8 is a circuit diagram showing a detailed arrangement of a color difference signal component (ER−EY) generator in FIG. 1.

To each color component detected by decoder 12, that is, each of 15 color components, i.e., 8 colors×2 luminance levels −1 and a sync signal, luminance signal component EY and two color difference signal components (ER−EY)/1.14 and (EB−EY)/2.03 are generated as binary value data, as shown in FIG. 6. In this case, component EY and components (ER−EY)/1.14 and (EB−EY)/2.03 are timed with the sync signal. In this embodiment, for simplifying subsequent digital processing, each value shown in FIG. 5 is multiplied 100 times, and the value of level "L" of the sync signal is set to be "0". It should be noted that a negative value is a 2's complement number. Component EY is generated by luminance signal component generator 13 whose arrangement is shown in detail in FIG. 7. More specifically, color information signals S0 to S14 from color decoder 12 are decoded according to the relationships defined in the column of EY in FIG. 6 and 8-bit signals $EY_{0-7}$ are generated. For example, signal $EY_7$ is set at logic "1" only if the input signals represent white or yellow with the full luminance. Then, NAND gate 13-7 gates signals S14 and S12. In the case of the sync signal, all color information signals S0 to S14 are set at level "H", so that signals $EY_{0-7}$ are set at logic "0".

Similarly, color information signals S1 to S12 (signals S0, S13 and S14 are set at logic "0" and can be omitted) are respectively decoded by (ER−EY) generator 141 and (EB−EY) generator 142 according to the relationships given in the columns of (ER−EY)/1.14 and (EB−EY)/2.03 in FIG. 6, and color difference signal components (ER−EY)/1.14 and (EB−EY)/2.03 are output as signals $RY_{0-6}$ and $BY_{0-6}$, respectively. In order to simplify subsequent processing, inverted outputs $-RY_{0-6}$ and $-BY_{0-6}$ are also output. (ER−EY) generator 141 for generating signals $RY_{0-6}$ and $-RY_{0-6}$ is shown in detail in FIG. 8. (EB−EY) generator 142 can be designed in the same manner as in generator 141.

In an NTSC video signal, color subcarrier having phases shifted by 90 degrees, that is, $\cos 2\pi fsct$ and $\sin 2\pi fsct$, are balanced-modulated with two color difference signal components (ER−EY)/1.14 and (EB−EY)/2.03 to prepare carrier chrominance signal CY.

$$\text{Video Signal} = EY + CY \tag{4}$$

$$CY = \{(ER-EY)1.14\}\cos 2\pi fsct + \{(EB-EY)/2.03\}\sin 2\pi fsct \tag{5}$$

Figure 9A:
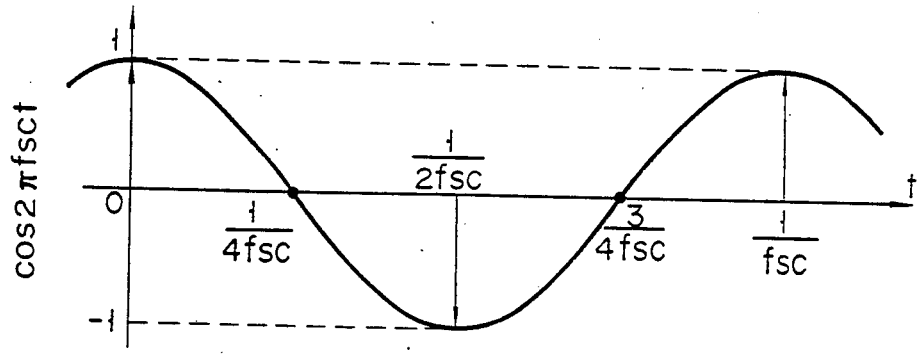
FIGS. 9A and B are charts respectively showing subcarrier waveforms which are phase-shifted by 90 degrees.
Figure 9B:
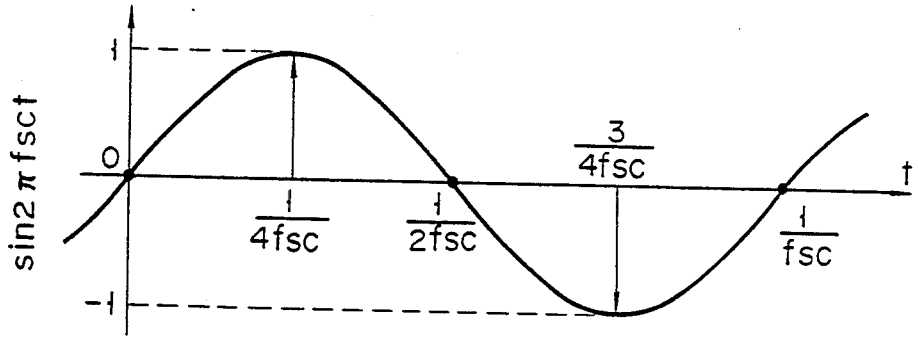

Components $\cos 2\pi fsct$ and $\sin 2\pi fsct$ represent waveforms having phases shifted by 90 degrees, as shown in FIGS. 9A and 9B, respectively. In order to perform digitally balanced modulation, values of color difference signal components (ER−EY)/1.14 and (EB−EY)/2.03 and the values obtained by multiplying the above values with "−1" are switched to each other with 4fsc. More specifically, if a sampling point of components $\cos 2\pi fsct$ and $\sin 2\pi fsct$ is defined as follows:

$$t = n/4fsc \text{ (for n=0, 1, 2, 3, . . . )} \tag{6}$$

signal CY can be obtained by using (ER−EY)/1.14, (EB−EY)/2.03, −(ER−EY)/1.14, −(EB−EY)/2.03, . . . Therefore, signals $RY_{0-6}$, $-RY_{0-6}$ and $BY_{0-6}$ and $-BY_{0-6}$ from (ER−EY) and (EB−EY) generators 141 and 142 are switched by color subcarrier (fsc) modulator 151 in an order of $RY_{0-6}$, $BY_{0-6}$, $-RY_{0-6}$, $-BY_{0-6}$, . . . thereby completing balanced modulation. In this case, since generators 141 and 142 generate signals $-RY_{0-6}$ and $-BY_{0-6}$ the arrangement of modulator 15 can be simplified.

Figure 10:
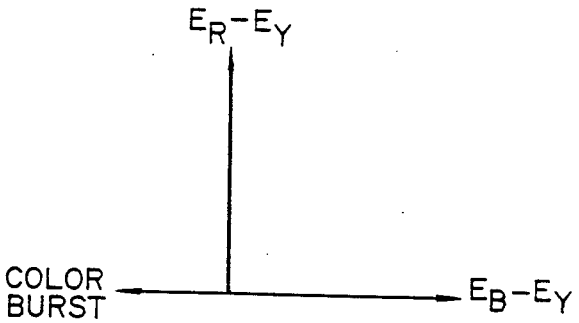
FIG. 10 is a vector diagram showing a relationship between the color burst signal and color difference signal components.
Figure 11:
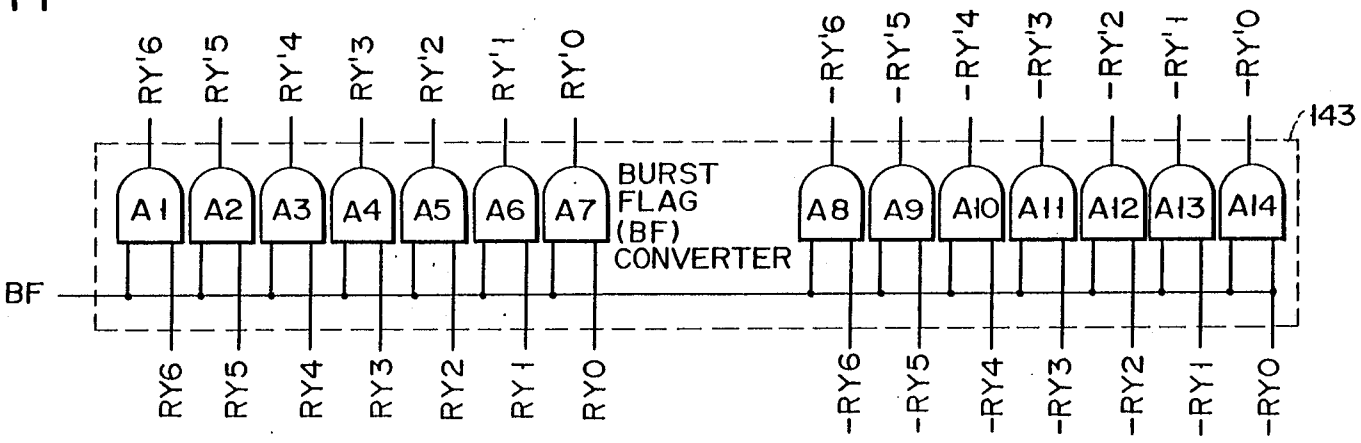
FIGS. 11 and 12 are circuit diagrams showing detailed arrangements of a burst flag (BF) converter in FIG. 1.
Figure 12:
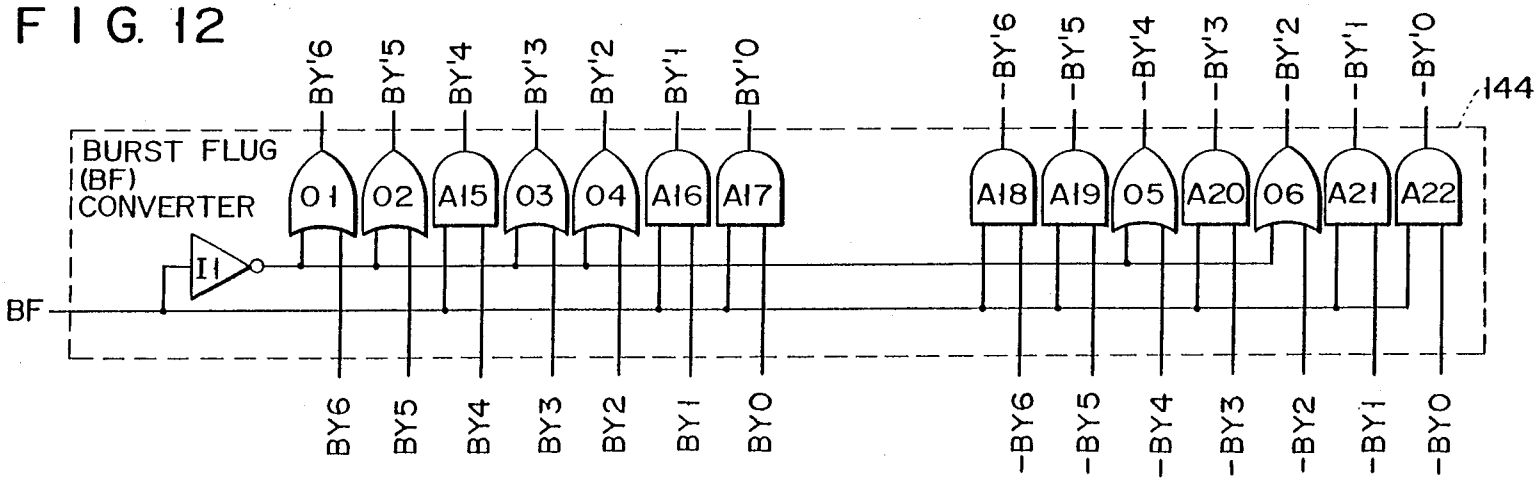

Since the color burst signal is superposed on the video signal during the burst period, as shown in FIG. 5, two color difference signal components (ER−EY)/1.14 and (EB−EY)/2.03 must be converted to the color burst components during the burst period. This conversion is performed by burst flag (BF) converters 143 and 144. As shown in FIG. 5, the relative amplitude value of the color burst signal is 0.2 (20 in this embodiment) and its phase is an opposite phase of the signals EB−EY, as shown in FIG. 10. As is best shown in FIG. 11, BF converter 143 causes AND gates A1 to A14 to convert signals $RY_{0-6}$ and $-RY_{0-6}$ into "0" during the burst period, i.e., while signal BF is set at level "L", thereby generating signal $RY'_{0-6}$, and $-RY'_{0-6}$. As shown in FIG. 12 BF converter 144 causes inverter II OR gates 01 to 06 and AND gates A15 to A22 to convert signal $BY_{0-6}$ and $-BY_{0-6}$ into "$-20(1101100_2)$" and "$20(0010100_2)$", thereby generating signals $BY'_{0-6}$ and $-BY'_{0-6}$. However, if signal BF is set at level "H" i.e., in a period excluding the burst period, components $RY_{0-6}$ and $-RY_{0-6}$ are output without modifications.

Output signals $RY'_{0-6}$, $-RY'_{0-6}$, $BY'_{0-6}$ and $-BY'_{0-6}$ from BF converters 143 and 144 are subjected to balanced modulation in modulator 15. Modulator 15 comprises subcarrier (fsc) modulator 151 for modulating the subcarrier (fsc) by switching between two color difference signal components and the components obtained by multiplying the above signal components with "−1", and sine-cosine switching pulse (sin·cos) generator 152 for generating switching pulses cos, sin, —cos and —sin required for switching. Generator 152 comprises a 4-stage ring counter using 4fsc (FIG. 14A) as a clock pulse frequency, as shown in FIG. 13. The ring counter comprises D flip-flops FF1 to FF4 and NOR gate N1. In order to simplify initialization, pulse SP1 (FIG. 14F) from NOR gate N1 is used as a set pulse in place of pulse —sin (FIG. 14E). The two color difference signal components are switched in fsc modulator 151 by switching pulses cos, sin, —cos and —sin (FIGS. 14B to 14E) generated by generator 152 in an order of $RY'_{0-6}$, $BY'_{0-6}$, $RY'_{0-6}$ and $BY'_{0-6}$. As a result, carrier chrominance signal component $CY'_{0-6}$ is derived by balanced-modulating the subcarrier.

In order to prevent mutual interference between the luminance and carrier chrominance signal components of the video signal, their high- and low-frequency components must be eliminated. In this embodiment, digital low-pass filter (DIGITAL-LPF) 16 performs the operation so as to cut off the high-frequency component of signal component $EY_{0-7}$. Digital band-pass filter (DIGITAL-BPF) 17 performs the operation so as to cut off the low-frequency component of component $CY_{0-6}$.

Figure 15:
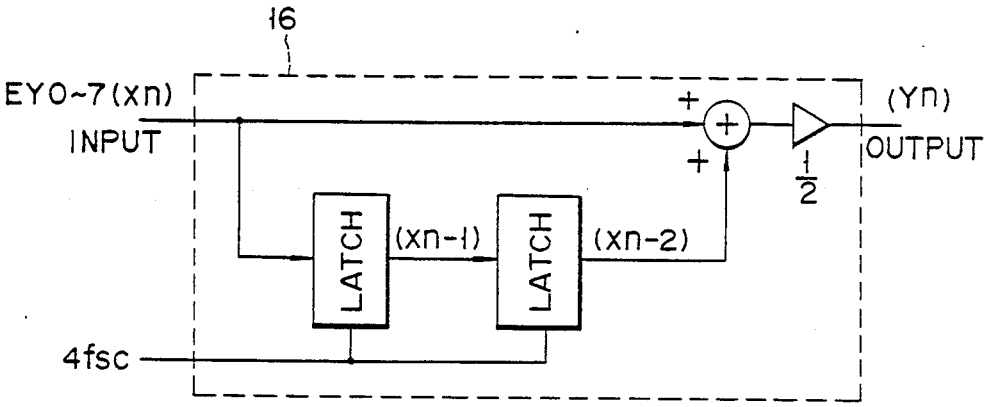
FIG. 15 is a circuit diagram showing a detailed arrangement of digital low-pass filter (DIGITAL-LPF) in FIG. 1.

FIG. 15 shows the circuit arrangement of DIGITAL-LPF 16 which comprises two latches, an adder, and a ½ attenuator.

Referring to FIG. 15 showing the circuit arrangement of DIGITAL-LPF 16, if three continuous sampling points are defined as $X_n$, $X_{n-1}$, and $X_{n-2}$, its output $Y_n$ is given as follows:

$$Y_n = (X_n + X_{n-2})/2 \text{ for n=0, 1, 2, . . .} \tag{7}$$

If the time series consists of sampled values of sine wave $X_n = e^{jn\omega T}$ (representation of complex number):

$$Y_n = (\tfrac{1}{2})(1 + e^{-j2\omega T})e^{jn\omega T} \quad (8)$$

$$= H(e^{j\omega T})e^{jn\omega T} \quad (9)$$

for $$H(e^{j\omega t}) = \cos\omega t \cdot e^{-j\omega t},$$

$$\omega = 2\pi f,$$

and $$T = 1/(4fsc)$$

Figure 16:
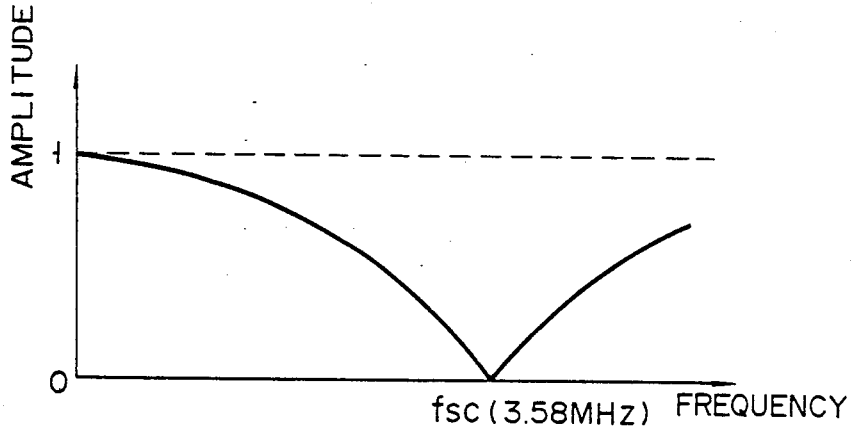
FIG. 16 is a graph for explaining the operation of the filter in FIG. 15.

Transfer function $H(e^{j\omega T})$ gives filter frequency characteristics, and the absolute value of $H(e^{j\omega T})$ has the amplitude characteristics having an attenuation point at fsc on the axis of frequency, as shown in FIG. 16. DIGITAL-LPF 16 has low-pass characteristics.

Figure 17:
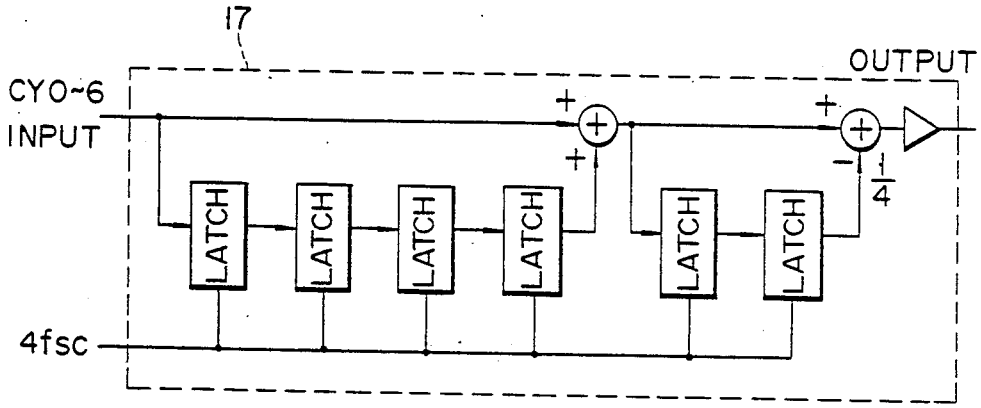
FIG. 17 is a circuit diagram showing a detailed arrangement of a digital band-pass filter (DIGITAL-BPF) in FIG. 1.
Figure 18:
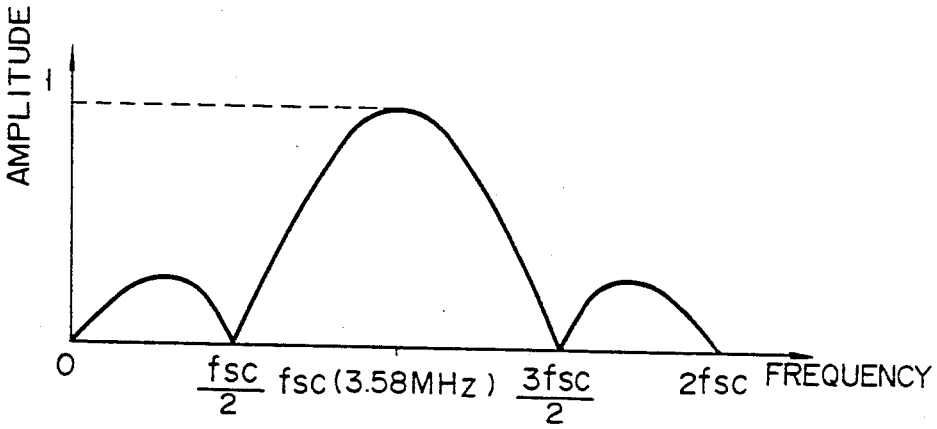
FIG. 18 is a graph for explaining the operation of the filter in FIG. 17.

FIG. 17 shows a circuit arrangement of DIGITAL-BPF 17. In FIG. 17, the front stage comprises a latch circuit and an adder, and the rear stage comprises two latches, an adder, and a $\frac{1}{4}$ attenuator.

DIGITAL-BPF 17 comprises two filters connected in series with each other and having transfer functions $G1(e^{j\omega T})$ and $G2(e^{j\omega T})$ as follows:

$$G1(e^{j\omega T}) = \cos 2\omega T \cdot e^{-j2\omega T}$$

$$G1(e^{j\omega T}) = \sin\omega T \cdot e^{(\pi/2 - \omega T)j}$$

therefore, total transfer function $H(e^{j\omega T})$ is given as follow:

$$H(e^{j\omega T}) = G1(e^{j\omega T}) \cdot G2(e^{j\omega t})$$

and the amplitude characteristics have fsc as the center frequency and fsc/2 and 3fsc/2 are attenuation points. In other words, DIGITAL-BPF 17 has band-pass characteristics. DIGITAL-LPF 16 and DIGITAL-BPF 17 have different delay times so that a latch (not shown) is provided to match the delay times.

The luminance signal component and the carrier chrominance signal component which are filtered by DIGITAL-LPF 16 and DIGITAL-BPF 17 are added by adder 18 to produce video signal $VY_{0-7}$ represented by equation (4). Latch 19 latches this video signal in response to clocks having a frequency of 4fsc. In other words, latch 19 outputs a binary digital value corresponding to the amplitude value of the desired video signal for a period corresponding to 4fsc.

Digital value $VY_{0-7}$ is converted into an analog value by D/A converter 20, and the high-frequency component thereof is cut off by normal analog low-pass filter 21, thereby extracting analog video signal VD.

According to the first embodiment as described above, when the digital chrominance signal output from the display controller is encoded to the analog video signal, most of the encoding operations are digitally performed. Unlike in conventional analog processing, analog peripheral components such as resistors, capacitors, inductors, or delay lines can be omitted. Therefore, potential problems caused by degradation of resistors or the like can be eliminated, and stable electrical characteristics can be maintained. Furthermore, since adjustment of the peripheral components need not be performed, assembly can be simplified and hence circuit reliability can be improved.

When the stage prior to the D/A converter is constituted by a digital IC, a simple circuit arrangement (i.e., the digital IC, the D/A converter and the low-pass filter) can be used to generate the video signal.

In the first embodiment, when the color subcarrier waveforms having phases shifted by 90 degrees are subjected to balanced modulation with two color difference signal components to produce carrier chrominance signal components, zero-crossing points of the opposite subcarriers are selected as four modulation points within the fsc period, so that the color difference signal components can be periodically switched.

According to the first embodiment, digital filtering is performed for the carrier chrominance signal components, so that the number of filters can be reduced as compared with the case wherein two color difference signal components are independently filtered.

A second embodiment of the present invention will be described below. The same reference numerals as in the second embodiment in FIG. 1 denote the same parts in the second embodiment in FIG. 19, and a detailed description thereof will be omitted. Carrier chrominance signal CY as the color component at the time of production of a video signal is obtained by balanced modulation of $\cos 2\pi fsct$ and $\sin 2\pi fsct$ with two color difference signal components (ER−EY and EB−EY). Balanced modulation is performed such that the zero point is selected as the modulation point, and binary values corresponding to the amplitude values of the two different color difference signals are switched at the 4fsc period. In this case, positive and negative values are required as the amplitude values. The color difference signal component generator for converting the two different color difference signals into binary data generates both the positive and negative values for each color. For this reason, the size of generator 14 in the first embodiment is large. In the second embodiment, the circuit arrangement of the color difference signal component generator is simplified.

Figure 20:
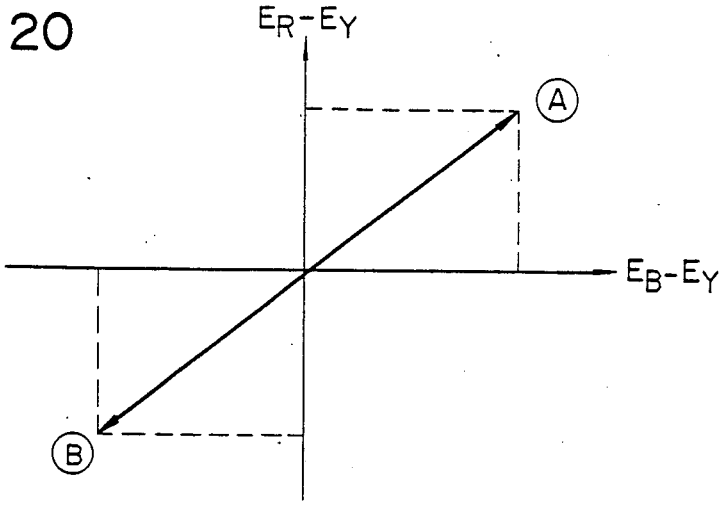
FIG. 20 is a vector diagram showing the relationship between complementary colors of the color components represented by chrominance signals.

A complementary color relationship of chrominance signals is given, as shown in FIG. 20. For example, color Ⓐ has complementary color Ⓑ. As is apparent from FIG. 20, the color and its complementary color are positive and negative with respect to the (ER−EY)-axis and (EB−EY)-axis, respectively. For example, if the (ER−EY) component of a given color has a positive amplitude value, its complementary color has a negative amplitude value. If the (ER−EY) component of the given color has a negative value, its complementary color has a negative amplitude value. This is also true for the (EB−EY) component.

Assume that color subcarrier components are balanced-modulated with color difference signal components (ER−EY) and (EB−EY). If a given color is converted into its complementary color at a timing when a negative value (i.e., a value obtained multiplying a positive value by "−1") of the color difference signal component is required, the negative amplitude value of the color difference signal component of the given color can be obtained. According to this principle of operation, it is unnecessary for the color difference signal component generator to generate both the positive and negative values, thereby simplifying its circuit arrangement.

Figure 19:
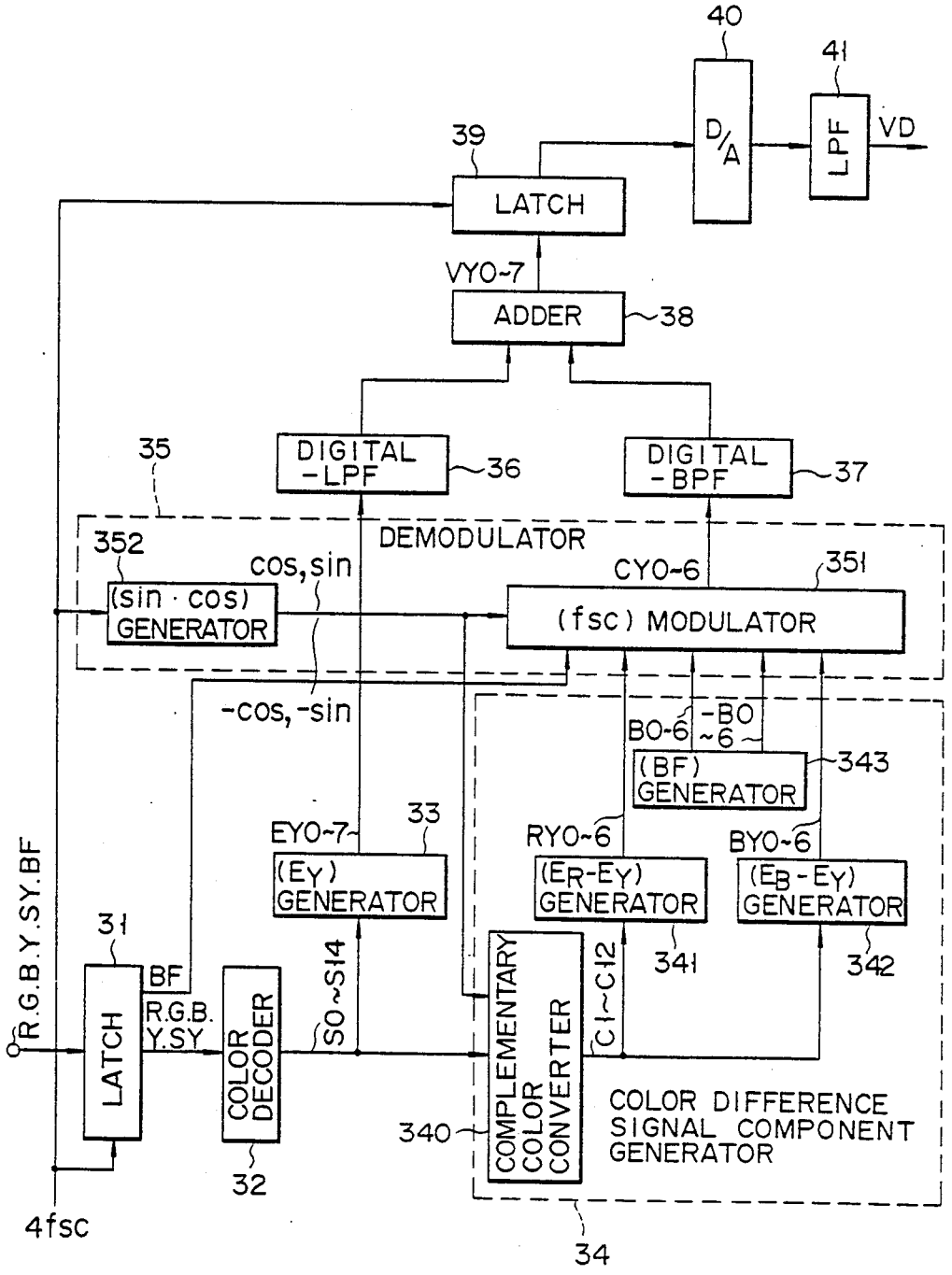
FIG. 19 is a block diagram showing a digital video encoder circuit according to a second embodiment of the present invention.

Referring to FIG. 19 showing the second embodiment, digital signals R, G, B, Y and the like are sampled by latch 31 and converted into color information signals S0 to S14 corresponding to 15 colors, i.e., 8 (colors)×2 (luminance levels)−1 (since black has only one illuminance level). This conversion is performed as shown in FIG. 3. The amplitude values of the color difference signal components (ER−EY)/1.14 and (EB−EY)/2.03 are given as values in FIG. 6. As is apparent from FIG. 6, yellow and blue (10 and −10 as decimal amplitude values of the (ER−EY)/1.14 components thereof; and −44 and 44 as decimal amplitude values of the (EB−EY)/2.03 components thereof), magenta and green (52 and −52; and 29 and −29), red and cyan (61 and −61; and −15 and 15) are respectively complementary.

Complementary color converter 340 of color difference signal component generator 34 serves as a switching circuit for switching signals having the complementary relationship described above at a timing of the negative value (i.e., the value obtained by multiplying the positive value by "−1") when the subcarrier is modulated with the corresponding color difference signal. The above timing is ½fsc or ¾fsc in FIG. 9, and pulse −cos or −sin in FIG. 14.

Figure 21:
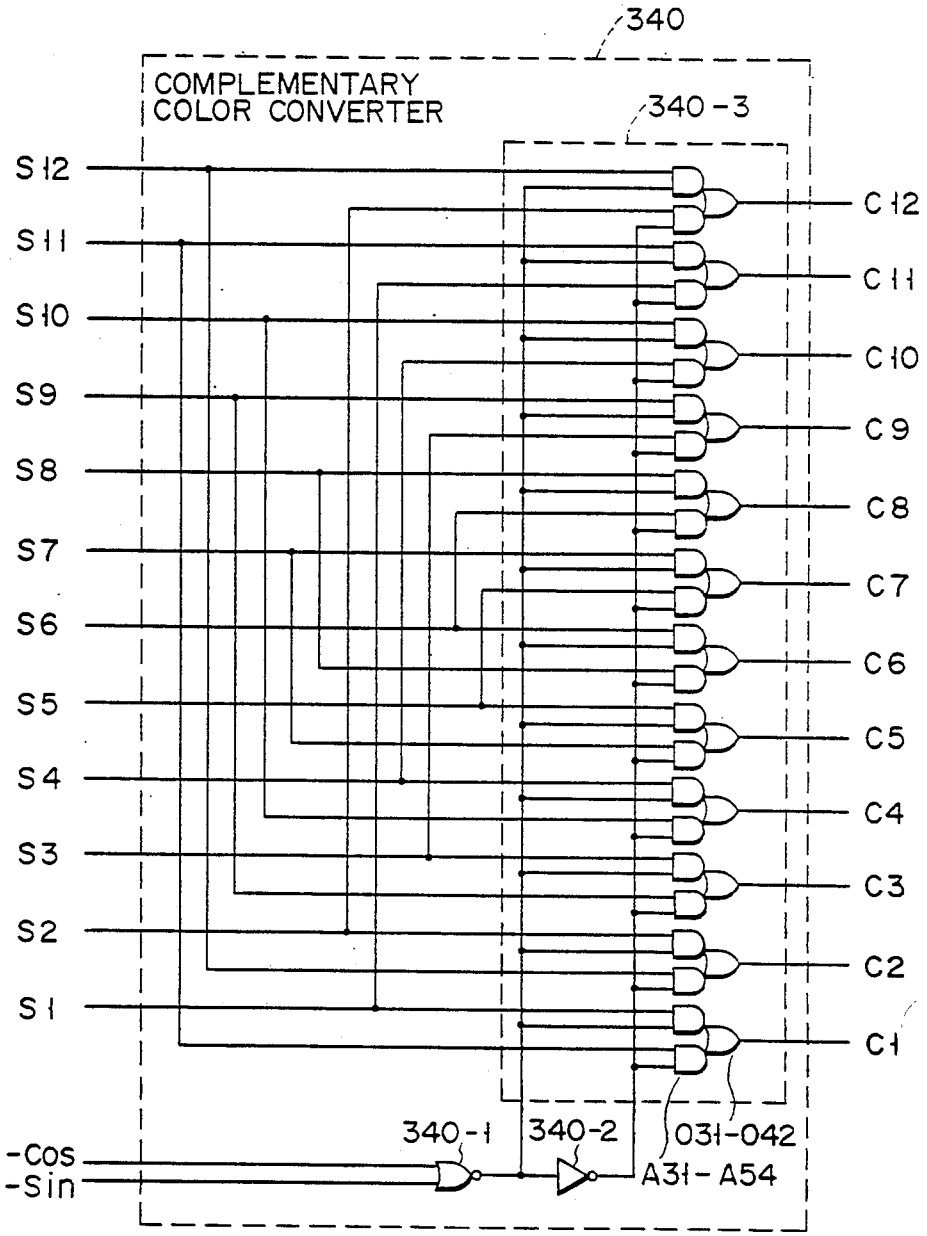
FIG. 21 is a circuit diagram showing a detailed arrangement of a complementary color converter in FIG. 19.

The detailed arrangement of complementary color converter 340 is shown in FIG. 21. Referring to FIG. 21, both pulses −cos and −sin are set at level "L" at timings 0 and ¼fsc in FIG. 9. An output from NOR gate 340-1 is set at level "H", while an output from inverter 340-2 is set at level "L". Switches 340-3 comprising AND gates A31 to A54 and OR gates 031 to 042 generate color information signals S1 to S12 as complementary relationship information signals C1 to C12, thereby obtaining the normal color state.

Since either pulse -cos or -sin is set at level "H" at a timing of ½fsc or ¾fsc, the output from NOR gate 340-1 is set at level "L" and an output from inverter 340-2 is set at level "H". The outputs from switches 340-3 are signals C1 to C12, representing the complementary relationship states of signals S1 to S12. For example, signal S12 is set at level "L" and all signals S1 to S11 are set at level "H" in the case of yellow with a full luminance. However, signal C2 of level "L" and signals C1 and C3 to C12 of level "H" appear at switches 340-3. This indicates a color state of blue with a full luminance as the complementary color of yellow with a full luminance.

Figure 22:
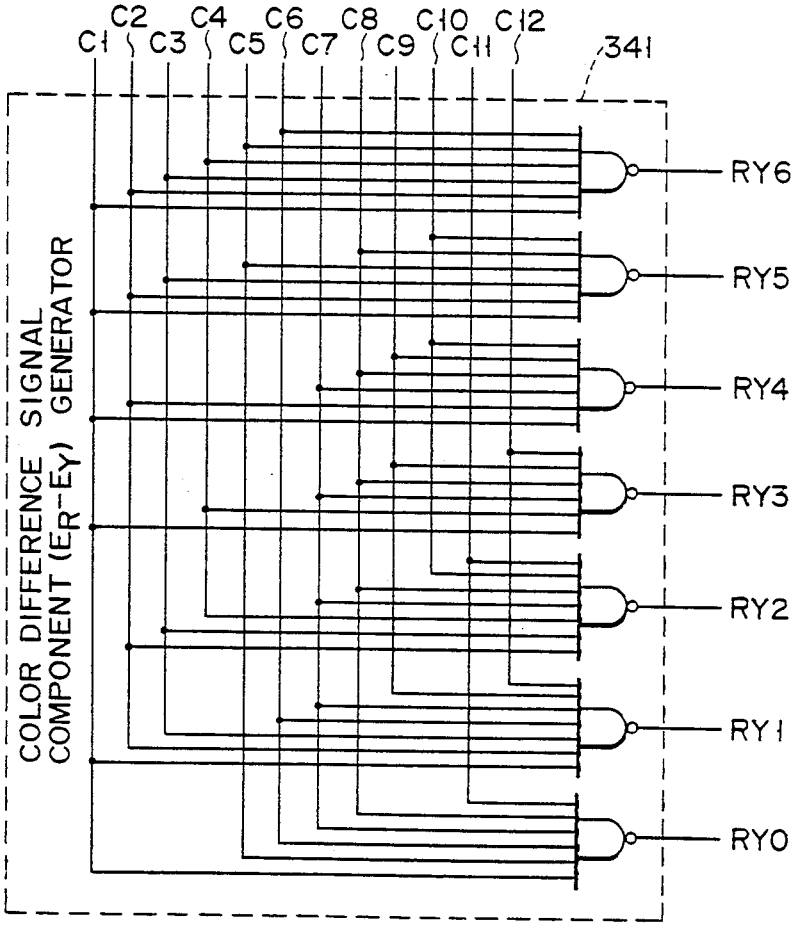
FIG. 22 is a circuit diagram showing a detailed arrangement of a color difference signal component (ER−EY) generator in FIG. 19.

Complementary color relationship information signals C1 to C12 output from complementary color converter 340 are decoded, and (ER−EY) generator 341 and (EB−EY) generator 342 generate color difference signal components (ER−EY)/1.14 and (EB−EY)/2.03 as 7-bit signals $RY_{0-6}$ and $BY_{0-6}$, respectively. As best shown in FIG. 22, generator 341 may be designed to generate only one of the positive and negative amplitude values of the color difference signal components and can be realized by a simple arrangement.

In order to perform balanced modulation of color subcarrier components with signals $RY_{0-6}$ and $BY_{0-6}$, the sampling points represented by equation (6) are selected to sequentially switch signals $RY_{0-6}$, $BY_{0-6}$, $RY_{0-6}$, $BY_{0-6}$, . . . in the order named. Since the color burst component is output during the burst period, BF generator 343 always outputs signals $B_{0-6}$ ("−20") and $-B_{0-6}$("20") representing the (EB−EY)-axis components of the color burst. In other words, during the burst period, signals "0", $B_{0-6}$, "0", $-B_{0-6}$, . . . are sequentially switched and output in place of signals $RY_{0-6}$ and $BY_{0-6}$.

Modulator 35, comprising fsc modulator 351 and sin·cos generator 352, performs the above-mentioned switching operation, and the subcarrier components are blanced-modulated to generate carrier chrominance signal component $CY_{0-6}$.

Luminance signal component $EY_{0-7}$ and carrier chrominance signal component $CY_{0-6}$ are filtered by DIGITAL-LPF 36 and DIGITAL-BPF 37, respectively, and added by adder 38, thereby obtaining digital video signal $VY_{0-7}$. Signal $VY_{0-7}$ is processed by latch 39, D/A converter 40, and LPF 41, and is output as analog video signal VD.

According to the second embodiment as described above, complementary color converter 340 is arranged to convert a state of a given color into a state of its complementary color at a proper timing, so that the arrangements of (ER−EY) and (EB−EY) generators 341 and 342 for generating the binary amplitude values of the color difference signal components can be simplified. For example, the hardware of generators 341 and 342 is reduced to ½ that of generators 141 and 142 in FIG. 1.

Since (fsc) modulator 351 switches only signals $RY_{0-6}$ and $BY_{0-6}$, the circuit arrangement can be advantageously made compact as compared with that of (fsc) modulator 151 in FIG. 1.

The present invention is not limited to the R, G and B signals as three primary signals and the color difference signals ER−EY and EB−EY. So-called chrominance signals EI and EQ, i.e., EI=0.736(ER−EY)−0.268(EB−EY) and EQ=0.478(ER−EY)+0.413(EB−EY), and color difference signal components corresponding to these signals may be used. The number of colors are not limited to 8 (colors)×2 (luminance levels)−1. The luminance and color difference signal components may be decoded by using a larger number of bits, thereby expressing a larger number of colors.

According to the present invention, since an analog video signal can be produced from a digital chrominance by digital processing, circuit adjustment need not be performed. Degradation of circuit characteristics can be eliminated to further improve circuit reliability.

What is claimed is:

1. A digital video encoder circuit comprising:

input means for receiving digital color information data to be encoded, the digital color information data including a plurality of color components and a luminance component having a predetermined relationship therewith;

decoding means for receiving the digital color information data from said input means and decoding the digital color information data into a predetermined number of pieces of color information consisting of specific color information and specific luminance information, the specific color information being uniquely defined by the relationship between the plurality of color components and the luminance component, and the specific luminance information being adapted to have a predetermined relationship with the specific color information;

first converting means for receiving the predetermined number of pieces of color information, converting the specific luminance information of each of the predetermined number of pieces of color information into a digital luminance signal component uniquely defined by the relationship between the specific color information and the specific luminance information, and outputting the digital luminance signal component;

second converting means for receiving the predetermined number of pieces of color information from said decoding means, converting two color difference signals uniquely defined by the relationship between the specific color information and the specific luminance information of each of the predetermined number of pieces of information into a digital color difference signal component, and outputting the digital color difference signal component;

color subcarrier component generating means for generating two color subcarrier components, the phase of which are shifted by 90 degrees;

modulating means for digitally performing balanced modulation for the two subcarrier components having phases shifted by 90 degrees from said color subcarrier component generating means by using the digital color difference signal components from said second converting means, and for outputting digital carrier chrominance signal components;

adding means for adding the digital carrier chrominance signal components from said modulating means and the digital luminance signal component from said first converting means, and for outputting digital video signal components; and third converting means for converting the digital video signal components from said adding means into an analog waveform and for outputting an analog video signal.

2. A circuit according to claim 1, wherein said input means comprises:

clock generating means for generating clocks having a frequency higher than the color subcarrier frequency; and sampling means for sampling the digital color information data in response to the clocks from said clock generating means.

3. A circuit according to claim 2, wherein the clocks have a frequency four times the color subcarrier frequency.

4. A circuit according to claim 1, further comprising digital low-pass filter means, coupled between said first converting means and said adding means, for performing an arithmetic operation for the digital luminance signal component so as to prevent the digital luminance signal component from interfering with the carrier chrominance signal component.

5. A circuit according to claim 1, further comprising digital band-pass filter means, coupled between said modulating means and said adding means, for performing an arithmetic operation for the digital carrier chrominance signal component so as to prevent the digital chrominance signal component from interfering with the luminance signal component.

6. A circuit according to claim 1, wherein said second converting means includes means for converting the two color difference signal components to a digital color burst component during a burst period of the video signal.

7. A circuit according to claim 1, wherein said color subcarrier component generating means generates four switching pulses in an order of sin, cos, −sin, and −cos corresponding to two color subcarrier components having phases shifted by 90 degrees and negative components of the two subcarrier components, and said modulating means switches the two color difference signal components with the four switching pulses.

8. A circuit according to claim 1, further comprising low-pass filter means for receiving the analog video signal from said third converting means and cutting off a high-frequency component therefrom.

9. A circuit according to claim 1, wherein said second converting means includes complementary color converting means for receiving the predetermined number of pieces of color information from said decoding means and the two color subcarrier components having different phases from said color subcarrier components having different phases from said color subcarrier component generating means, and for outputting complementary color relationship information between the predetermined number of pieces of color information at predetermined timings on the basis of the two color subcarrier components, and color difference signal component generating means for converting the two color difference signal components into digital color difference signal components on the basis of the complementary color relationship information from said complementary color converting means.

* * * * *